US008708639B2

(12) United States Patent
Subramaniyan

(10) Patent No.: US 8,708,639 B2
(45) Date of Patent: Apr. 29, 2014

(54) TURBINE BUCKET SHROUD TAIL

(75) Inventor: Moorthi Subramaniyan, Bangalore Karnataka (IN)

(73) Assignee: The Coca-Cola Company, Atlanta, GA (US)

( * ) Notice: Subject to any disclaimer, the term of this patent is extended or adjusted under 35 U.S.C. 154(b) by 870 days.

(21) Appl. No.: 12/901,644

(22) Filed: Oct. 11, 2010

(65) Prior Publication Data

US 2012/0087775 A1 Apr. 12, 2012

(51) Int. Cl.
*F01D 5/20* (2006.01)
*F01D 5/14* (2006.01)

(52) U.S. Cl.
CPC . *F01D 5/20* (2013.01); *F01D 5/145* (2013.01); *F05D 2240/307* (2013.01); *Y10S 415/914* (2013.01)
USPC ..... 415/1; 415/173.5; 415/173.6; 415/914

(58) Field of Classification Search
USPC ..... 415/1, 173.1, 173.5, 173.6, 228, 914; 416/189, 190, 191, 192
See application file for complete search history.

(56) References Cited

U.S. PATENT DOCUMENTS

| | | | | | |
|---|---|---|---|---|---|
| 5,188,507 | A * | 2/1993 | Sweeney | 415/173.1 |
| 5,234,318 | A * | 8/1993 | Brandon | 416/192 |
| 5,290,144 | A * | 3/1994 | Kreitmeier | 415/173.1 |
| 6,102,655 | A * | 8/2000 | Kreitmeier | 415/173.3 |
| 2008/0075600 | A1 * | 3/2008 | Moors et al. | 416/189 |
| 2009/0214345 | A1 | 8/2009 | DeMania et al. | |
| 2010/0092295 | A1 | 4/2010 | Riaz et al. | |
| 2011/0250064 | A1 * | 10/2011 | Neeli et al. | 415/211.2 |

* cited by examiner

*Primary Examiner* — Edward Look
*Assistant Examiner* — Jason Davis
(74) *Attorney, Agent, or Firm* — Sutherland Asbill & Brennan LLP

(57) ABSTRACT

The present application provides an axial flow turbine. The axial flow turbine may include a stator casing and a turbine bucket positioned about the stator casing. A tip shroud may be positioned on the turbine bucket. A shroud tail may be attached to the tip shroud at a downstream end of the tip shroud.

19 Claims, 5 Drawing Sheets

TURBINE BUCKET SHROUD TAIL

TECHNICAL FIELD

The present application relates generally to turbine engines and more particularly relates to a turbine bucket with a shroud tail for use in a low pressure steam turbine or other types of axial flow turbines so as to increase the radial flow angle and to limit shroud wake losses for improved overall turbine efficiency.

BACKGROUND OF THE INVENTION

The steam flow path in a steam turbine generally is formed by a stationary casing and a rotor. A number of stationary vanes may be attached to the casing in a circumferential array and extend inwardly into the steam flow path. Similarly, a number of rotating blades or buckets may be attached to the rotor in a circumferential array and extend outwardly into the steam flow path. The stationary vanes and the rotating buckets may be arranged in alternating rows such that a row of stationary vanes and the immediately downstream row of rotating buckets form a turbine stage. The stationary vanes serve to direct the flow of steam such that it enters the downstream row of rotating buckets at an efficient angle. The airfoil portion of each rotating bucket extracts energy from the flow of steam so as to develop the power necessary to drive the rotor and a load attached thereto.

As the flow of steam passes through the steam turbine, the pressure drops through each succeeding stage until a desired discharge pressure is achieved. As such, the properties of the flow of steam such as temperature, pressure, velocity, moisture content, and the like may vary from stage to stage as the flow of steam expands through the flow path. Consequently, each row of buckets may have an airfoil shape that is optimized by the steam conditions associated with that row. Other configurations of steam turbines also may be known.

It is generally recognized that the performance of a steam turbine may be greatly influenced by the design and the performance of the later stage buckets operating at the reduced steam pressures. Ideally, the last stage buckets should efficiently use the expansion of the flow of steam down to the desired turbine exhaust pressure while minimizing the kinetic energy of the flow of steam leaving this last stage. Improving efficiency at the later stage buckets thus should improve overall efficiency of the steam turbine.

There is therefore a desire for improved steam turbine designs and related performance, particularly for the buckets of the last or the later stage of a low pressure steam turbine and the like. Such an improved turbine bucket design should improve overall steam turbine efficiency and performance while limiting flow separation, wake losses, and other types of flow path instabilities impacting on the flow of steam therethrough. Such improvements also may be applicable to any type of axial flow turbine including a gas turbine.

SUMMARY OF THE INVENTION

The present application thus provides an axial flow turbine. The axial flow turbine may include a stator casing and a turbine bucket positioned about the stator casing. A tip shroud may be positioned on the turbine bucket. A shroud tail may be attached to the tip shroud at a downstream end of the tip shroud.

The present application further provides a method of operating an axial flow turbine. The method may include the steps of increasing an angle of a downstream portion of a stator casing beyond about fifty degrees (50°) or more off of a horizontal line and rotating a bucket within the stator casing to generate a flow of steam or other combustion gases between the bucket and the stator casing. A tip shroud of the bucket may include a shroud tail on a downstream end thereof. The method further may include the step of directing the flow of steam or other combustion gases onto the stator casing by the shroud tail so as to increase a radial flow angle, reduce wake loses and other instabilities therein for improved efficiency.

The present application further provides for a turbine with a flow of steam or other combustion gases therein. The turbine may include a turbine bucket, a tip shroud positioned on the turbine bucket, a shroud tail attached to the tip shroud at a downstream end of the tip shroud, and a diffuser positioned downstream of the turbine bucket. The shroud tail directs the flow of steam or other combustion gases about the diffuser for improved efficiency.

These and other features and improvements of the present application will become apparent to one of ordinary skill in the art upon review of the following detailed description when taken in conjunction with the several drawings and the appended claims.

DETAILED DESCRIPTION

Figure 1:
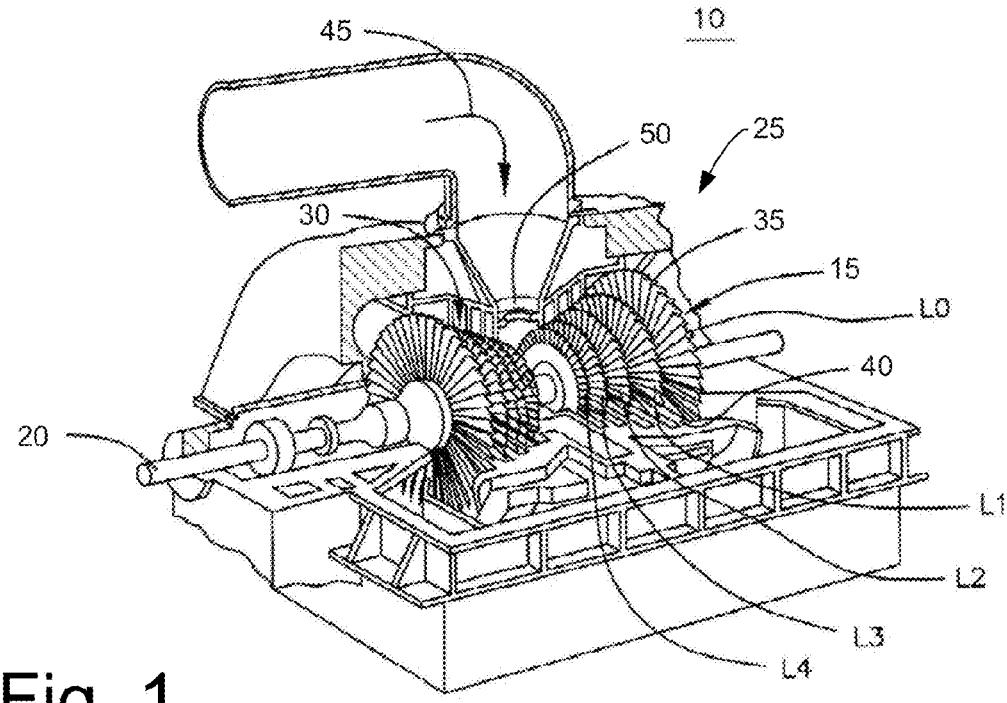
Fig. 1 Prior Art
FIG. 1 is a perspective view of a portion of a known steam turbine showing a number of stages therein.

Referring now to the drawings, in which like numerals refer to like elements throughout the several views, FIG. 1 shows a partial perspective view of a known axial flow turbine such as a steam turbine 10. The steam turbine 10 may include a rotor 15 with a shaft 20 as part of a low pressure turbine 25. The low pressure turbine 25 may include a number of axially spaced rotor wheels 30. A number of rotor buckets 35 may be mechanically coupled to each rotor wheel 30. More specifically, the rotor buckets 35 may be arranged in rows that extend circumferentially around each rotor wheel 30. A number of stationary nozzles 40 may extend circumferentially around the shaft 20 and may be axially positioned between the adjacent rows of the rotor buckets 35. The nozzles 40 may cooperate with the rotor buckets 35 to form a turbine stage and to define a portion of a steam flow path through the steam turbine 10. Other configurations may be used herein.

In operation, a flow of steam 45 enters an inlet 50 of the steam turbine 10 and may be channeled through the nozzles 40. The nozzles 40 direct the flow of steam 45 downstream against the rotating buckets 35. The flow of steam 45 passes through each of the succeeding stages and imparts a force on the buckets 35 so as to cause the rotor 15 to rotate. By way of example only, the low pressure turbine 25 may be seen to have five (5) stages. The five stages may be referred to as L0, L1, L2, L3, and L4. The L4 stage may be the first stage and the smallest (in a radial direction). The L3 stage is the second stage and is the next stage in an axial direction. The L2 stage is the third stage and is shown in the middle of the five stages. The L1 stage is the fourth and the next to last stage. The L0 stage is the last stage and is the largest (in a radial direction). Any number of stages may be used herein.

Figure 2:
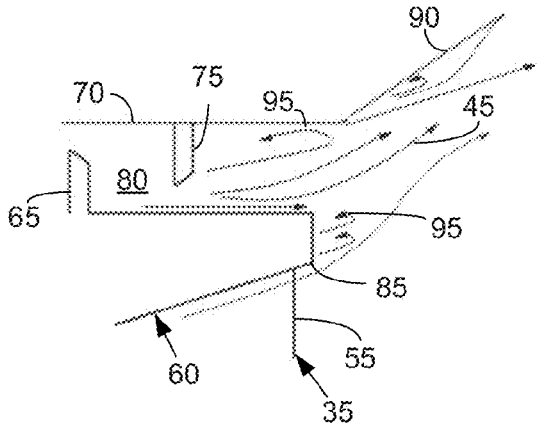
Fig. 2 Prior Art
FIG. 2 is a side plan view of a portion of a known steam turbine with a rotor bucket having a shroud thereon positioned about a stator casing.

FIG. 2 shows an example of one of the buckets 35. In this example, the bucket 35 may have an airfoil portion 55. The airfoil portion 55 may end in a tip shroud 60. The tip shroud 60 may include one or more shroud teeth 65 positioned thereon. The bucket 35 may be positioned about a stator casing 70 about one of the nozzles 40. The stator casing 70 may have one or more stator teeth 75 positioned thereon. The tip shroud 60 of the bucket 35 and the stator casing 70 may define a pathway 80 for the flow of steam 45 to pass therethrough. As may be seen, the tip shroud 60 may have a relatively blunt end 85 at a downstream end thereof. Other configurations of buckets 35 and stator casings 70 may be known.

In a desire to reduce the length or span of the buckets 35, an angle of a downstream portion 90 of the stator casing 70 may be increased. This increased angle, however, may cause the flow of steam 45 to separate from the stator casing 70 about the downstream portion 90 and about the tip shroud 60. Specifically, increasing the angle of the downstream portion 90 of the stator casing 70 beyond an angle of about 48° or so from the horizontal may cause the flow of steam 45 to separate from the stator casing 70 and in fact may cause vortices 95 to form downstream of the stator teeth 75 and about the blunt end 85 of the tip shroud 60. This flow separation may cause increased wake instability as well as the vortices 95 therein. As such, the flow separation may impact overall steam turbine 110 performance and efficiency.

Figure 3:
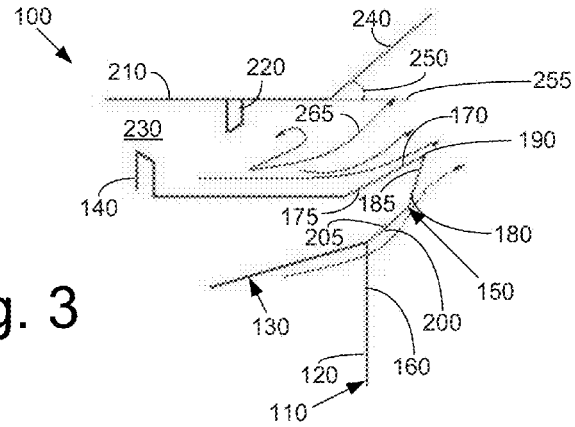
FIG. 3 is a side plan view of a portion of a steam turbine as may be described herein with a rotor bucket having a tip shroud with a shroud tail and positioned about a stator casing.

FIG. 3 shows a portion of an axial flow turbine 100 as may be described herein. The axial flow turbine 100 may be a stream turbine, a gas turbine, and the like. The axial flow turbine 100 may include a number of rotating buckets 110 positioned in successive stages. The rotating buckets 110 may include an airfoil portion 120 with a tip shroud 130 thereon. The tip shroud 130 may include one or more shroud teeth 140 thereon. Other configurations of turbines, buckets, shrouds, and teeth may be used herein.

The tip shroud 130 of the bucket 110 also may include a shroud tail 150 positioned about a downstream end 160 thereof. The shroud tail 150 may be largely tooth-like or wedge-like in shape. The shroud tail 150 may have a top surface 170 extending from the tip shroud 130 at a top angle 175 and a middle surface 180 extending downwardly at a retracting or other angle 185 from the top surface 170. The top surface 170 and the middle surface 180 may meet at a point 190 or other type of juncture. A bottom surface 200 may extend back towards the tip shroud 130 at a further angle 205. The shroud tail 150 also may include multiple steps, curves, and any other desired shape. As such, the respective shapes, lengths, angles of the surfaces 180, 190, and 200 of the shroud tail 150 may vary. Each of the surfaces 180, 190, and 200 need not be used together. Likewise, additional surfaces also may be used.

The shroud tail 150 may be used with the buckets 110 of the last stage (L0), the next to last stage (L1), the third stage (L2), or otherwise. Different configurations of the shroud tails 150 may be used for different stages, different bucket shapes, as well as differing operating configurations.

In the inner stages, such as L1, L2, and L3, the bucket 110 may be positioned about a stator casing 210. The stator casing 210 may be similar to that described above or otherwise. The stator casing 210 may have one or more stator teeth 220 positioned thereon. The tip shroud 130 of the bucket 110 and the stator casing 210 may define a pathway 230 for the flow of steam 45 or other types of combustion gases therethrough. The stator casing 210 also may include a downstream portion 240. The downstream portion 240 may have an angle 250 from a horizontal line 255 that may be about 50° or more. Other angles and other types of stator casing configurations may be used herein.

The shroud tail 150 thus has the top surface 170 that extends from the tip shroud 130 at the top angle 175 of the top surface 170 towards the stator casing 210. The top angle 175 of the shroud tail 150 may or may not be somewhat similar to the angle 250 of the downstream portion 240 of the stator casing 210. The shroud tail 150 thus directs the flow of steam 45 or other types of combustion gases upward in a higher radial flow angle 265 as compared to the tip shroud 60 described above with the relatively blunt end 85. The higher radial flow angle 265 thus causes the flow of steam 45 or other types of combustion gases to stay largely attached to the stator casing 210. This higher radial flow angle 265 thus leads to a higher downstream portion 240 angle and hence a shorter flow path therethrough and reduced wake loses therein. Likewise, the retracting angle 185 of the middle surface 180 and/or the further angle 205 of the bottom surface 200 also help to avoid the creation of the vortices 95 and the like at the downstream end 160 of the tip shroud 130.

Figure 4:
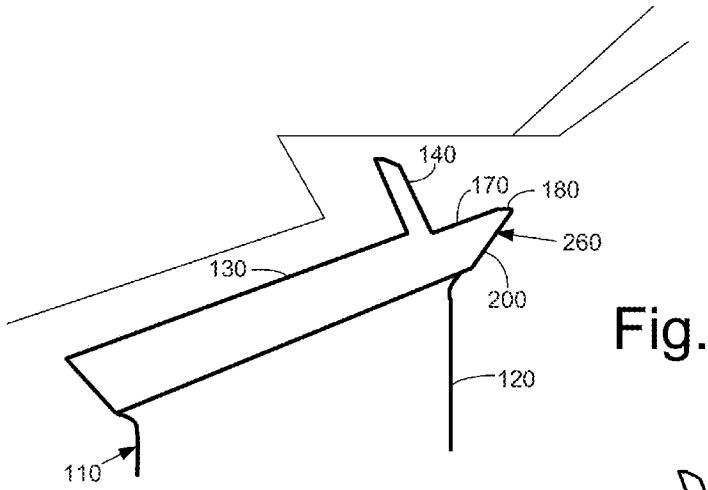
FIG. 4 is a side plan view of an alternative embodiment of a rotor bucket having a tip shroud with a shroud tail.
Figure 5:
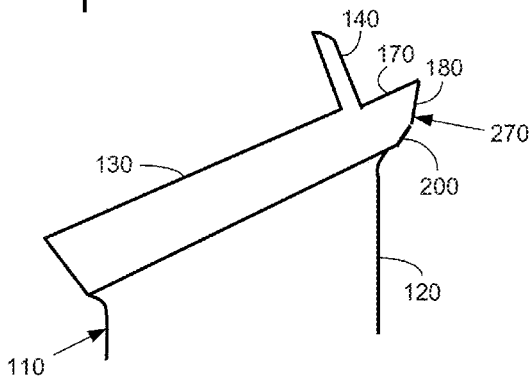
FIG. 5 is a side plan view of an alternative embodiment of a rotor bucket having a tip shroud with a shroud tail.
Figure 6:
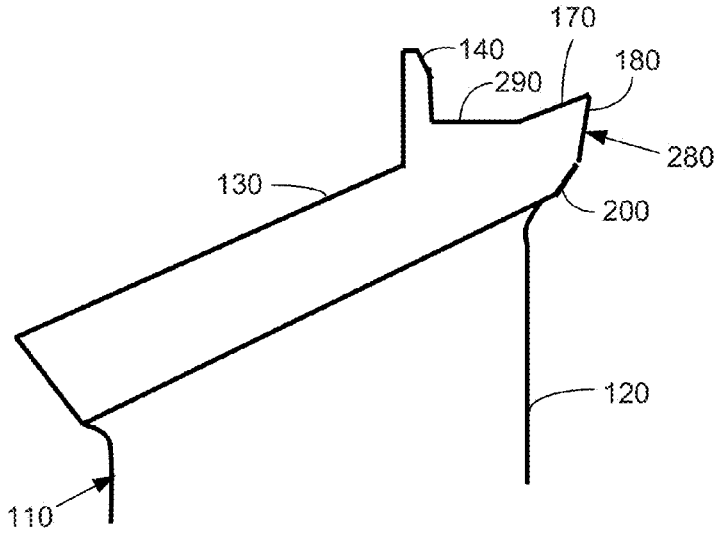
FIG. 6 is a side plan view of an alternative embodiment of a rotor bucket having a tip shroud with a shroud tail.
Figure 7:
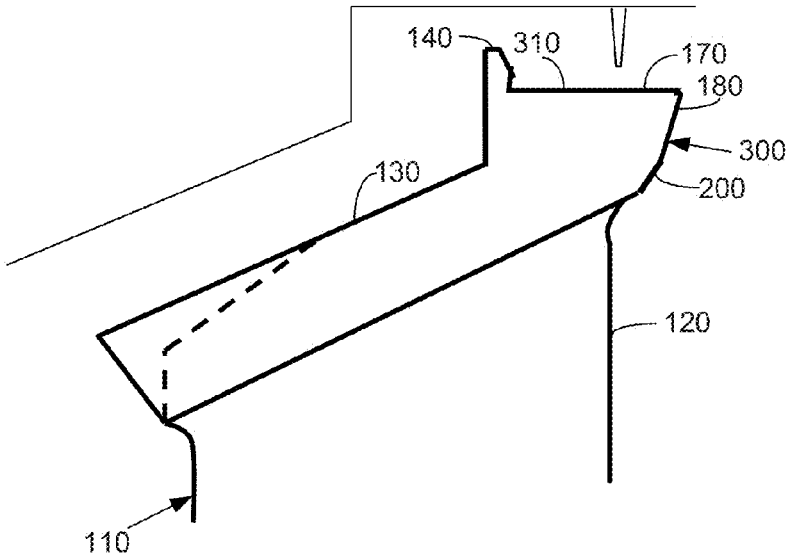
FIG. 7 is a side plan view of an alternative embodiment of a rotor bucket having a tip shroud with a shroud tail.

FIGS. 4-7 show varying embodiments of the tip shroud 130 and the shroud tail 150. For example, FIG. 4 shows a shroud tail 260 with essentially a flat top surface 170 and a very short middle surface 180. A shroud tooth 140 may be positioned closer to the shroud tail 260 that that described above. Likewise, FIG. 5 also shows a shroud tail 270 with the flat top surface 170 and the nearby shroud tooth 140. FIG. 6 shows a shroud tail 280 that extends from a shroud tooth 140 and includes an angled connection surface 290 between the tooth 140 and the top surface 170. FIG. 7 shows a shroud tail 300 with a flat connecting surface 310. Many other shroud tail 150 configurations may be used herein.

Figure 8:
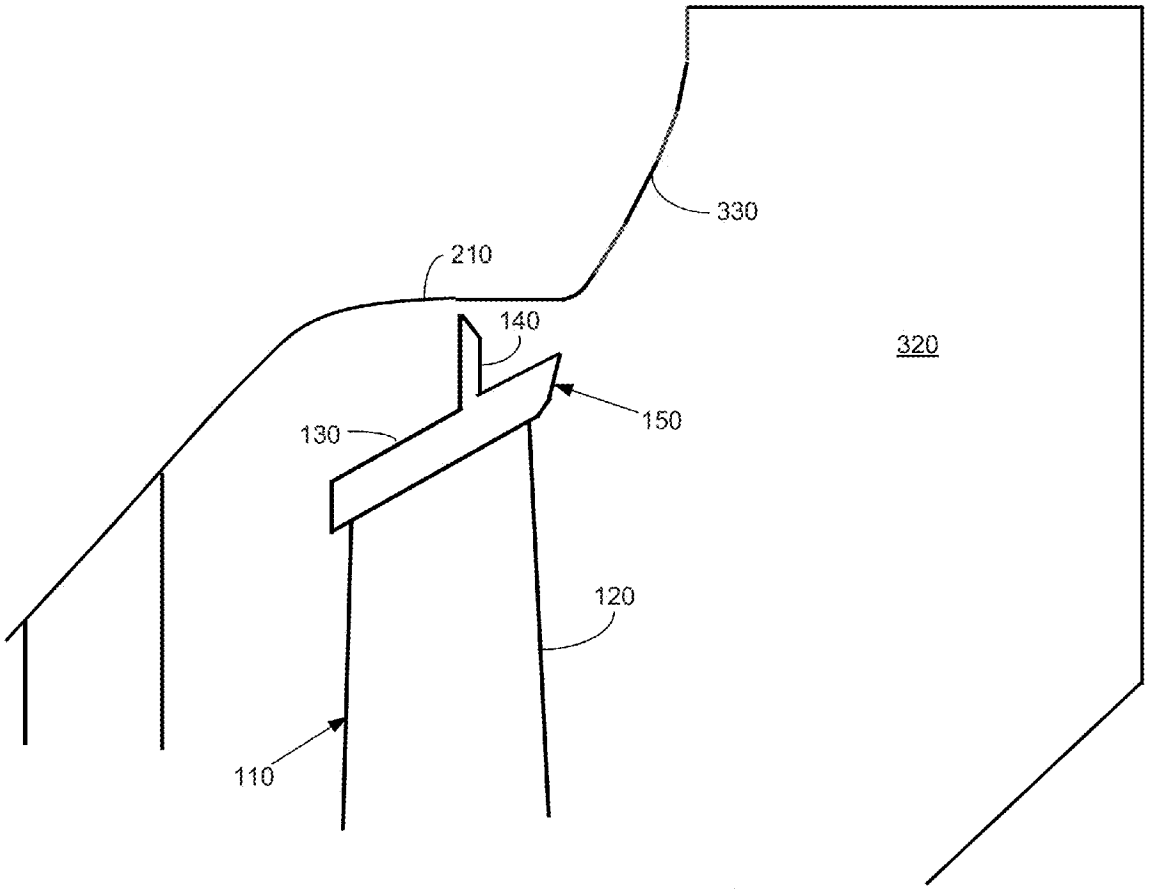
FIG. 8 shows a side plan view a rotor bucket having a tip shroud with a shroud tail and positioned about a radial diffuser.
Figure 9:
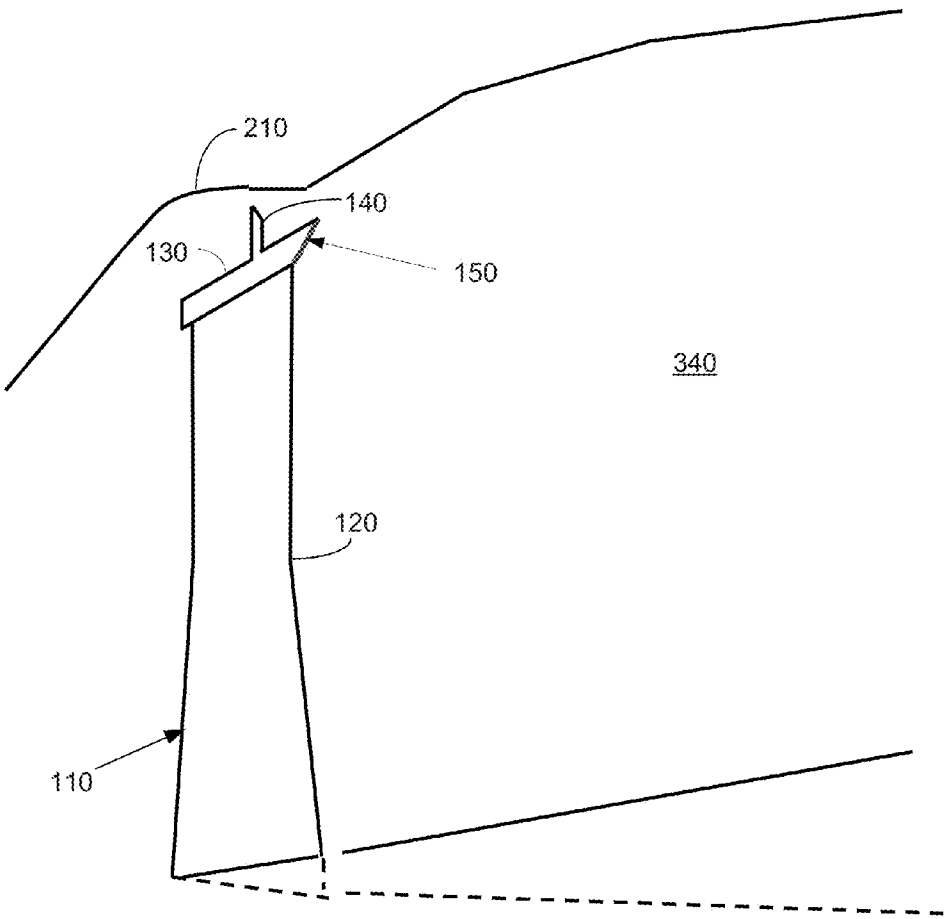
FIG. 9 shows a side plan view a rotor bucket having a tip shroud with a shroud tail and positioned about an axial diffuser.

FIG. 8 shows the use of the bucket 110 with the tip shroud 130 and the shroud tail 150 in the context of the last stage L0. The stator casing 210 about the last stage L0 may expand into a radial or down flow hood diffuser 320. By providing the higher radial flow angle 265 via the shroud tail 150, the radial diffuser 320 may include a more aggressive steam guide 330. Moreover, the radial diffuser 320 itself may be shorter given the high radial flow angle 265 for the flow of steam 45 or other types of combustion gases therethrough. FIG. 9 is similar in that it shows the bucket 110 with the tip shroud 130 and the shroud tail 150 in the context of an axial diffuser 340. Typical axial diffusers 340 already may utilize the radial flow angle 265 coming out of the bucket 110. The use of the shroud tail 150 may increase the radial flow angle 265 even further for improved performance and a shorter diffuser 340. Other configurations may be used herein.

By attaching the flow of steam 45 to the stator casing 210 via the shroud tail 150, the vortices 95 described above and/or other types of wake loses thus may be reduced or eliminated. The elimination of these vortices 95 and the general improvement in overall shroud wake losses may improve the overall efficiency and performance of the axial flow turbine 100. Moreover, the aggressive steam guide 330 now may be used herein in the last stage L0 about the diffuser 320. The diffusers 320, 340 also may now be shorter. The shroud tail 150 thus largely acts as a flow energizer. The flow of steam 45 or other types of combustion gases, or more of the flow, thus stays attached to the stator casing 210 for a reduced flow path therethrough given the higher radial flow angle 265.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. An axial flow turbine, comprising:

a stator casing;

a turbine bucket positioned about the stator casing;

a tip shroud positioned on the turbine bucket; and a shroud tail comprising a top surface and a bottom surface, the shroud tail attached to the tip shroud at a downstream end of the tip shroud;

wherein the top surface of the shroud tail extends radially outward from a top surface of the tip shroud, and the bottom surface of the shroud tail extends away from a bottom surface of the tip shroud towards the stator casing, such that at an obtuse angle is formed between the bottom surface of the shroud tail and the bottom surface of the tip shroud.

2. The axial flow turbine of claim 1, wherein the tip shroud comprises one or more tip shroud teeth and wherein the stator casing comprises one or more stator casing teeth.

3. The axial flow turbine of claim 1, wherein the stator casing comprises a downstream portion.

4. The axial flow turbine of claim 3, wherein the downstream portion of the stator casing comprises an angle of at least fifty degrees(50°) or more off of a horizontal line.

5. The axial flow turbine of claim 1, wherein the top surface of the shroud tail extends radially outward at an angle from the tip shroud.

6. The axial flow turbine of claim 5, wherein the shroud tail comprises a middle surface adjacent to the top surface.

7. The axial flow turbine of claim 6, wherein the top surface of the tip shroud and the middle surface of the tip shroud meet at a point.

8. The axial flow turbine of claim 1, further comprising a flow of steam or other types of combustion gases passing between the tip shroud and the stator casing and wherein the shroud tail directs the flow of steam or other combustion gases about the stator casing.

9. The axial flow turbine of claim 1, wherein the turbine bucket is positioned within one of three last stages of the axial flow turbine.

10. The axial flow turbine of claim 1, wherein the stator casing extends into a radial diffuser downstream of the turbine bucket.

11. The axial flow turbine of claim 1, wherein the stator casing extends into an axial diffuser downstream of the turbine bucket.

12. A method of operating an axial flow turbine, comprising:

increasing an angle of a downstream portion of a stator casing beyond at least about fifty degrees(50°) or more off of a horizontal line;

rotating a bucket within the stator casing to generate a flow of steam or other combustion gases between the bucket and the stator casing;

wherein a tip shroud of the bucket comprises a shroud tail on a downstream end thereof, the shroud tail comprising a bottom surface that forms an obtuse angle with a bottom surface of the tip shroud; and directing the flow of steam or other combustion gases onto the stator casing by the shroud tail so as to increase a radial flow angle and reduce wake loses therein.

13. The method of claim 12, wherein the step of directing the flow of steam or other combustion gasses comprises directing the flow of steam or other combustion gases onto a radial diffuser.

14. The method of claim 12, wherein the step of directing the flow of steam or other combustion gasses comprises directing the flow of steam or other combustion gases onto an axial diffuser.

15. A turbine with a flow of steam or other combustion gases therein, comprising:

a turbine bucket;

a tip shroud positioned on the turbine bucket;

a shroud tail attached to the tip shroud at a downstream end of the tip shroud, the shroud tail comprising a top surface and a bottom surface; and a diffuser positioned downstream of the turbine bucket;

wherein the top surface of the shroud tail extends radially outward from a top surface of the tip shroud, and the bottom surface of the shroud tail extends away from a bottom surface of the tip shroud towards the stator casing, such that at an obtuse angle is formed between the bottom surface of the shroud tail and the bottom surface of the tip shroud; and the shroud tail directs the flow of steam or other combustion gases about the diffuser.

16. The turbine of claim 15, wherein the diffuser comprises a radial diffuser.

17. The turbine of claim 15, wherein the diffuser comprises an axial diffuser.

18. The turbine of claim 15, wherein the diffuser comprises a downstream portion positioned at an angle of at least fifty degrees (50°) or more off of a horizontal line.

19. The turbine of claim 15, wherein the top surface of the shroud tail extends radially outward at an obtuse or straight angle from the tip shroud.

* * * * *

UNITED STATES PATENT AND TRADEMARK OFFICE

CERTIFICATE OF CORRECTION

PATENT NO. : 8,708,639 B2
APPLICATION NO. : 12/901644
DATED : April 29, 2014
INVENTOR(S) : Moorthi Subramaniyan et al.

It is certified that error appears in the above-identified patent and that said Letters Patent is hereby corrected as shown below:

On the Title Page, Item (73) should read

-- (73) Assignee: "General Electric Company, Schenectady, NY" --

Signed and Sealed this
Eighteenth Day of November, 2014

Michelle K. Lee

Michelle K. Lee
*Deputy Director of the United States Patent and Trademark Office*